US008505157B2

(12) United States Patent
Cho et al.

(10) Patent No.: US 8,505,157 B2
(45) Date of Patent: Aug. 13, 2013

(54) VACUUM CLEANER

(75) Inventors: Jeong-hee Cho, Gwangju (KR); Dong-hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 573 days.

(21) Appl. No.: 12/460,932

(22) Filed: Jul. 27, 2009

(65) Prior Publication Data

US 2010/0071152 A1 Mar. 25, 2010

Related U.S. Application Data

(66) Substitute for application No. 61/192,559, filed on Sep. 19, 2008.

(30) Foreign Application Priority Data

Oct. 20, 2008 (KR) ..... 10-2008-0102584

(51) Int. Cl.
*A47L 9/10* (2006.01)
*A47L 9/20* (2006.01)

(52) U.S. Cl.
USPC ..... 15/347; 15/350; 15/353

(58) Field of Classification Search
USPC ..... 15/347–353
See application file for complete search history.

(56) References Cited

U.S. PATENT DOCUMENTS

| | | | | |
|---|---|---|---|---|
| 6,782,584 | B2 * | 8/2004 | Choi | 15/352 |
| 6,991,667 | B2 * | 1/2006 | Yang et al. | 55/429 |
| 2002/0178535 | A1 * | 12/2002 | Oh et al. | 15/352 |
| 2007/0011842 | A1 * | 1/2007 | Moon et al. | 15/352 |
| 2008/0282497 | A1 * | 11/2008 | Griffith et al. | 15/352 |

* cited by examiner

*Primary Examiner* — Bryan R Muller
(74) *Attorney, Agent, or Firm* — Ohlandt, Greeley, Ruggiero & Perle, LLP.

(57) ABSTRACT

A vacuum cleaner is provided that includes a cleaner body; a dust separating apparatus fixed to the cleaner body; a first dust receptacle detachably attached to the cleaner body on a bottom portion of the dust separating apparatus to collect large particle dust; a second dust receptacle detachably attached to the cleaner body on a bottom portion of the first dust receptacle to collect fine particle dust; and a locking device having a first position in which the dust separating apparatus is closely contacted to the first and second dust receptacles, and a second position in which the dust separating apparatus is spaced apart from the first and second dust receptacles at a predetermined interval. The second dust receptacle is detached from the first dust receptacle at the second position, and is detached from the cleaner body after the first dust receptacle is disengaged from the cleaner body.

13 Claims, 7 Drawing Sheets

VACUUM CLEANER

CROSS-REFERENCE TO RELATED APPLICATIONS

This application claims benefit under 35 U.S.C. §119(e) from U.S. Provisional Patent Application No. 61/192,559, filed on Sep. 19, 2008, in the United States Patent and Trademark Office, and claims benefit under 35 U.S.C. §119(a) from Korean Patent Application No. 10-2008-0102584, filed on Oct. 20, 2008, in the Korean Intellectual Property Office, the disclosure of which is incorporated herein by reference.

BACKGROUND OF THE INVENTION

1. Field of the Invention

An aspect of the present disclosure relates to a vacuum cleaner, and more particularly, to a vacuum cleaner in which the operation of detaching a dust receptacle is improved and thus user's convenience is enhanced.

2. Description of the Related Art

Generally, a cyclone dust separating apparatus mounted to an upright vacuum cleaner includes a dust receptacle having a large capacity. If a dust separating apparatus includes a first cyclone apparatus to collect large particle dust and a second cyclone apparatus to collect fine particle dust, the dust separating apparatus may include a first dust collecting unit to collect large particle dust and a second dust collecting apparatus to collect fine particle dust.

When the first and second dust collecting units are provided to separate the collected dust according to the volume thereof, a partition wall may be mounted in the dust receptacle.

However, if the first and second dust collecting units are divided by mounting the partition wall in a single dust receptacle to accommodate both large and fine particle dust, the fine particle dust scatters when dust are thrown out, and thus a user's hand is stained with the fine particle dust.

Alternatively, the second dust collecting unit may be connected to a bottom end of the first dust collecting unit. In this case, the first and second dust collecting units may employ a locking structure such as twist connection. A user empties the first dust collecting unit containing large particle dust more frequently than the second dust collecting unit. Accordingly, a user experiences inconvenience to detach the second dust collecting unit together with the first dust collecting unit from a cleaner body although the second dust collecting unit is not full of fine particle dust. A user should additionally work in order to detach the second dust collecting unit from the first dust collecting unit, and in this situation, it is possible for the fine particle dust contained in the second dust collecting unit to scatter or stain a user's hand.

SUMMARY OF THE INVENTION

Exemplary embodiments of the present disclosure address at least the above problems and/or disadvantages and other disadvantages not described above. Also, the present disclosure is not required to overcome the disadvantages described above, and an exemplary embodiment of the present disclosure may not overcome any of the problems described above.

The present disclosure provides a vacuum cleaner in which the structure to engage and disengage a dust receptacle is improved and thus user's convenience is enhanced.

According to an exemplary aspect of the present disclosure, there is provided a vacuum cleaner, including a cleaner body; a dust separating apparatus that is fixed to the cleaner body; a first dust receptacle that is detachably attached to the cleaner body, is disposed on a bottom portion of the dust separating apparatus, and collects large particle dust from the dust separating apparatus; a second dust receptacle that is detachably attached to the cleaner body, is disposed on a bottom portion of the first dust receptacle, and collects fine particle dust from the dust separating apparatus; and a locking device that comprises a first position in which the dust separating apparatus is closely contacted to the first and second dust receptacles, and a second position in which the dust separating apparatus is spaced apart from the first and second dust receptacles at a predetermined interval. The second dust receptacle is detached from the first dust receptacle at the second position, and may be detached from the cleaner body after the first dust receptacle is disengaged from the cleaner body.

The locking device may include a slope way that is formed on the cleaner body to face a bottom surface of the second dust receptacle; and a rotational handle that ascends and descends along the slope way and, thus, moves the second dust receptacle upward or downward.

The rotational handle may include a handle body; a lever that is protruded from the handle body; and a hook that is protruded on an upper portion of the lever.

At least one auxiliary slope way may be formed inside the slope way to correspond to a portion of the handle body. The handle body may include an auxiliary sliding slope way that is formed to have a shape corresponding to the auxiliary slope way on a portion facing the auxiliary slope way.

The lever may include a hook that is protruded towards the second dust receptacle, and the second dust receptacle may include a hook groove that faces the hook, wherein the hook may be hooked with the hook groove at the first position, maintain connection between the second dust receptacle and the handle body while moving to the second position, and lower the second dust receptacle.

The hook groove may include an opening portion into or from which the hook is inserted or detached at the second position; and a blocking member that prevents the hook from being detached from the opening portion when the hook moves to the first position.

The first dust receptacle may be detached in the forward direction of the cleaner body, and the second dust receptacle may be raised to a portion where the first dust receptacle is disposed, and is detached in the forward direction of the cleaner body.

The cleaner body may include a guide rail that supports the first dust receptacle; and a supporting portion that is formed on a portion corresponding to the guide rail of the first dust receptacle.

The cleaner body may further include a first protruding unit that prevents the first dust receptacle from rotating; and a second protruding unit that prevents the second dust receptacle from rotating. The first dust receptacle may include a guide groove that is engaged with the first protruding unit, and the second dust receptacle may include a guide recess that is engaged with the second protruding unit.

The second dust receptacle may include an air outlet on a bottom surface thereof. The air outlet may include a filter member that filters dirt or dust from a discharging air. The rotational handle may include an air passage that is formed in communication with the air output.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE INVENTION

Figure 1:
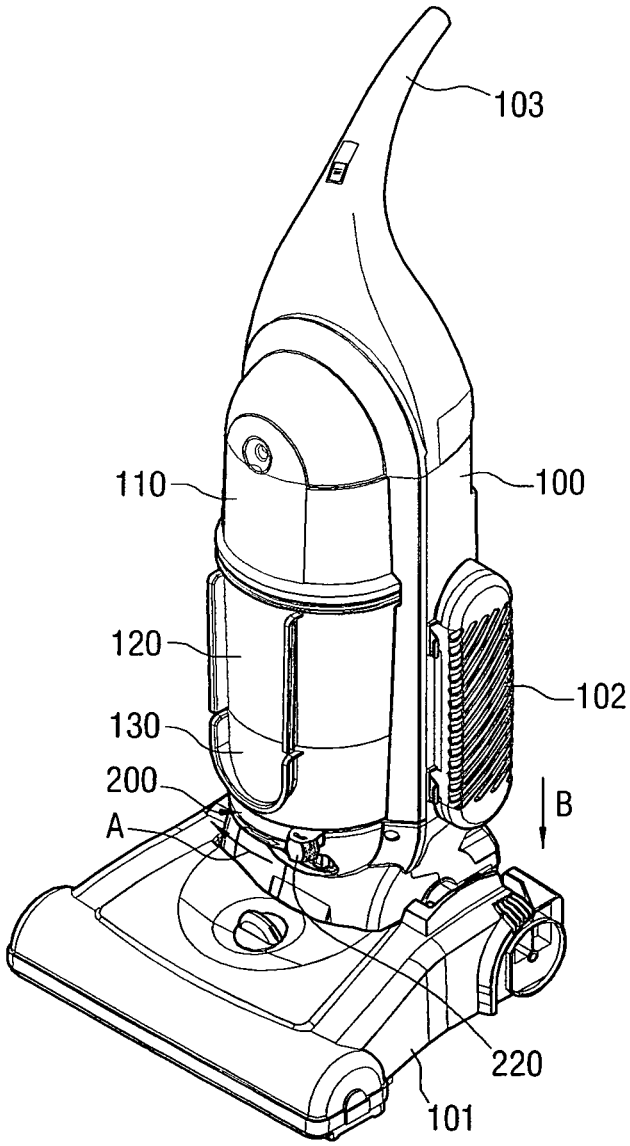
FIG. 1 is a perspective view illustrating a vacuum cleaner according to an exemplary embodiment of the present disclosure.

Certain exemplary embodiments of the present disclosure will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the disclosure. Thus, it is apparent that the present disclosure can be carried out without those specifically defined matters. Also, well-known functions or constructions are not described in detail since they would obscure the disclosure with unnecessary detail.

FIGS. 1 to 4 depict an example of a vacuum cleaner according to an exemplary embodiment of the present disclosure, and are views illustrating the process of detaching first and second dust receptacles.

The vacuum cleaner according to an exemplary embodiment of the present disclosure includes a cleaner body 100, a dust separating apparatus 110, a first dust receptacle 120, a second dust receptacle 130, and a locking device 200.

The cleaner body 100 includes a vacuum suction motor (not shown) to form a negative pressure therein, and a suction nozzle 101 that draws in dust-laden air from a surface, an exhaust grill 102 through which exhaust air is discharged, and a handle 103 that a user holds.

The dust separating apparatus 110 is fixedly engaged with the cleaner body 100, and is configured to draw in dust-laden air that is sucked by the suction nozzle 101 and to separate the dust-laden air into large particle dust and fine particle dust.

The first dust receptacle 120 is disposed under the dust separating apparatus 110, and collects large particle dust that is separated by the dust separating apparatus 110. If a locking device 200 is unlocked, the first dust receptacle 120 is detached from the dust separating apparatus 110 in a forward direction of the cleaner body 100.

A guide groove 125 to guide the first dust receptacle 120 is formed at both sides of the first dust receptacle 120 so that although the locking device 200 rotates, the first dust receptacle 120 does not rotate and moves only upward and downward. The guide groove 125 is engaged with a first protruding unit 105 that is formed on a portion corresponding to the cleaner body 100. The first protruding unit 105 is an elastic plate formed on the cleaner body 100 as a single body. If a user forces to attach or detach the first dust receptacle 120 to or from the cleaner body 100, the first dust receptacle 120 may be unlocked from the guide groove 125 by the elastic deformation.

A supporting portion 129 is formed around an upper portion of the first dust receptacle 120, and a guide rail 109 to which the supporting portion 129 is inserted is formed in the cleaner body 100. As the guide rail 109 is engaged with the supporting portion 129, when the locking device 200 is unlocked, the first dust receptacle 120 descends only as much as the first dust receptacle 120 is spaced apart from the dust separating apparatus 110, but maintains a set height. Accordingly, the second dust receptacle 130 that descends when the locking device 200 is unlocked may be detached from the first dust receptacle 120.

The second dust receptacle 130 is disposed under the first dust receptacle 120, and collects fine particle dust that is separated by the dust separating apparatus 110. If a locking device 200 is unlocked, the first dust receptacle 120 is detached from the cleaner body 100 and then the second dust receptacle 130 is detached from the first dust receptacle 120. If the first dust receptacle 120 is detached from the cleaner body 100 in a forward direction of the cleaner body 100, the second dust receptacle 130 is raised to an upper portion where the first dust receptacle 120 was disposed, and is detached from the cleaner body 100 in a forward direction of the cleaner body 100.

Figure 4:
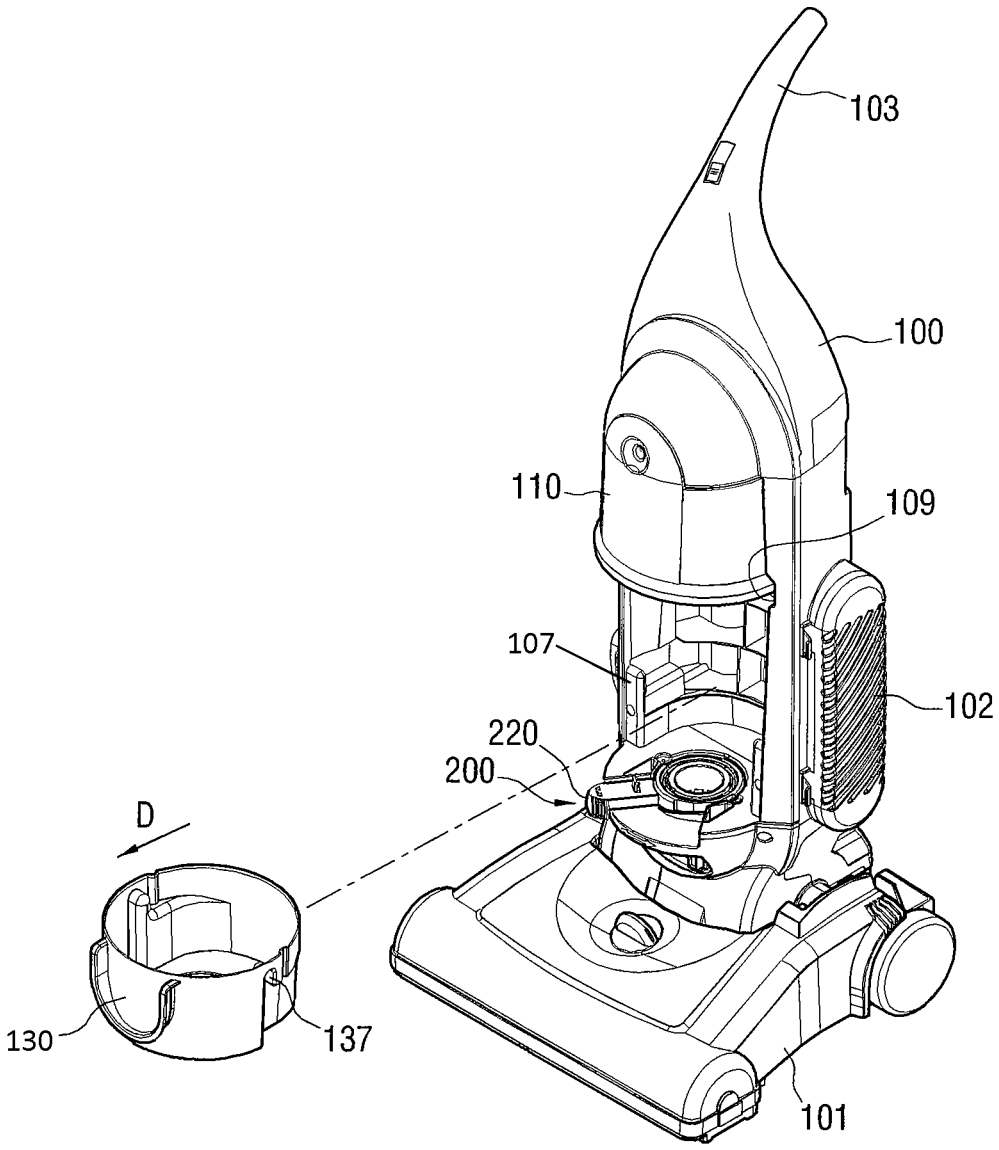

A guide recess 137 to guide the second dust receptacle 130 is formed at both sides of the second dust receptacle 130 as shown in FIG. 4 so that although the locking device 200 rotates, the second dust receptacle 130 does not rotate and moves only upward and downward. The guide recess 137 is engaged with a second protruding unit 107 that is formed on a portion corresponding to the cleaner body 100. The second protruding unit 107 is formed in a lengthwise direction of the cleaner body 100. Accordingly, when the second dust receptacle 130 is attached to or detached from the cleaner body 100, the second protruding unit 107 guides the second dust receptacle 130 upward and downward.

The locking device 200 is configured to rotate between a first position and a second position. In the first position, the dust separating apparatus 110 is locked and sealed with the first and second dust receptacles 120 and 130, and in the second position, the dust separating apparatus 110 is spaced apart from the first and second dust receptacles 120 and 130 at a predetermined interval, and thus the dust separating apparatus 110 is unlocked and unsealed from the first and second dust receptacles 120 and 130.

Figure 5:
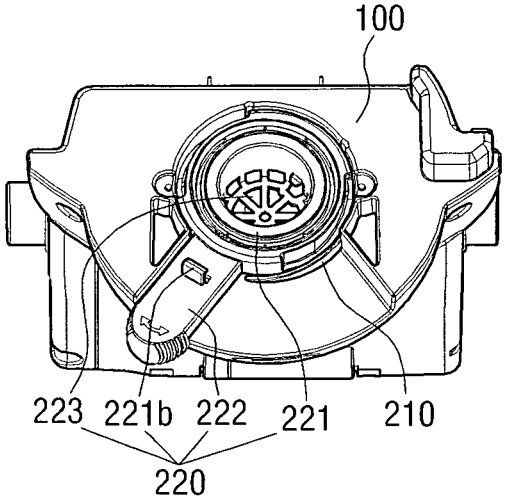
FIG. 5 is a perspective view illustrating part of a locking device having a rotational handle according to an exemplary embodiment of the present disclosure.
Figure 6:
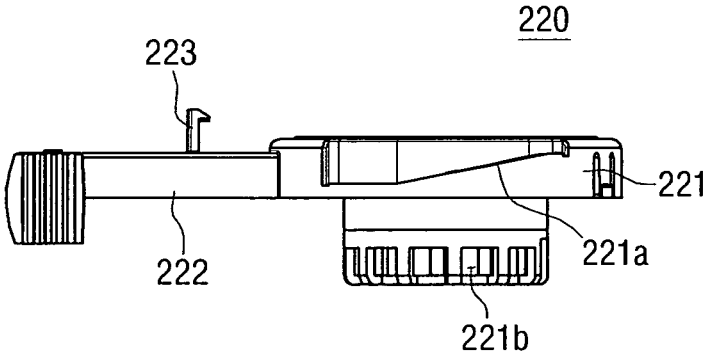
FIG. 6 is a side view illustrating the rotational handle of FIG. 5.
Figure 7:
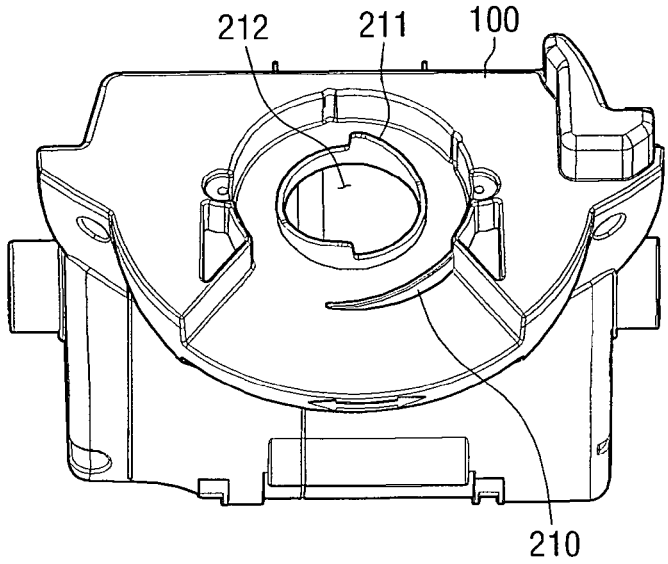
FIG. 7 is a perspective view illustrating a bottom surface of a cleaner body from which the rotational handle is disengaged.

The locking device 200 includes a slope way 210 and a rotational handle 220 as shown in FIGS. 5 to 7.

The slope way 210 is formed on the cleaner body 100 to face a bottom surface of the second dust receptacle 130, and a discharging port 212 is formed at the center of the slope way 210. At least one auxiliary slope way 211 may be formed between the slope way 210 and the discharging port 212 at the same axle.

The rotational handle 220 is ascended and descended by the slope way 210 and the auxiliary slope way 211, and raises and lowers the second dust receptacle 130.

The rotational handle 220 includes a handle body 221, a lever 222, a hook 223, an auxiliary sliding slope way 221*a*, and an air passage 221*b* as shown in FIGS. 5 and 6.

The handle body 221 is closely contacted to the bottom surface of the second dust receptacle 130, and includes the auxiliary sliding slope way 221*a* and the air passage 221*b*.

The auxiliary sliding slope way 221*a* is formed on a portion corresponding to the auxiliary slope way 221, and raises and lowers the handle body 221 in association with the rotation of the handle body 221. According to the exemplary embodiment of the present disclosure, if a user rotates the handle body 221 towards the first position, the auxiliary sliding slope way 221*a* moves along the auxiliary slope way 211 and thus raises the handle body 221, and if the handle body 221 rotates from the first position to the second position, the auxiliary sliding slope way 221*a* moves along the auxiliary slope way 211 and thus lowers the handle body 221.

The air passage 221*b* is formed at the center of the handle body 221. At the first and second positions, the handle body 221 is closely contacted to the bottom surface of the second dust receptacle 130, and seals and connects between the discharging port 212 and an air outlet 139 formed at the center of the bottom surface of the second dust receptacle 130.

The lever 222 is protruded from the handle body 221 at a specific length, and thus a user can hold the lever 222 to rotate the handle body 221. Referring to FIGS. 5 to 7, the lever 222 moves along the slope way 210, and ascends and descends the handle body 221. That is, if a user rotates the lever 222 towards the first position, the lever 222 moves along the slope way 210 and thus ascends the handle body 221, and if the lever 222 moves from the first position to the second position, the lever 222 moves along the slope way 210 and thus descends the handle body 221.

The hook 223 is protruded on an upper portion of the lever 222. The hook 223 is inserted into a hook groove 230 formed on the second dust receptacle 130 at the first position. The hook 223 is released from the hook groove 230 at the second position.

Figure 8:
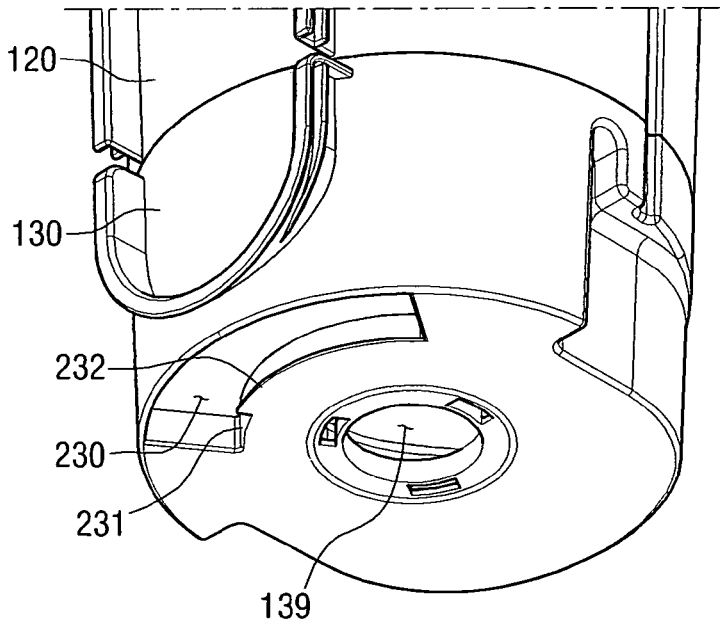
FIG. 8 is a perspective view illustrating a bottom surface of a second dust receptacle that is engaged with the rotational handle of FIG. 5.

The hook groove 230 includes an opening part 231 and a blocking part 232 as shown in FIG. 8.

The opening part 231 enables the hook 223 to be inserted into or released from the hook groove 230 at the second position.

The blocking part 232 is formed in a parallel direction to the moving direction of the hook 223. If the rotational handle 220 rotates from the first position to the second position, the hook 223 hooks the blocking part 232 and thus the second dust receptacle 130 is closely contacted to the rotational handle 220. Accordingly, if the rotational handle 220 rotating from the first position to the second position descends, the second dust receptacle 130 may also descend.

Figure 9:
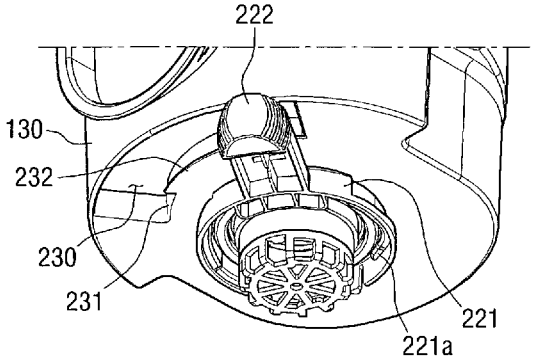
FIG. 9 is a perspective view in which the rotational handle of FIG. 5 is engaged with the second dust receptacle.

FIG. 9 illustrates the coupling between the hook 223 and the hook groove 230 at the first position. Referring to FIG. 9, the blocking part 232 supports the hook 223 at the first position. The coupling between the hook 223 and the hook groove 230 enables the second dust receptacle 13 and the rotational handle 220 to be closely contacted with each other.

The operation of detaching the dust receptacles of the vacuum cleaner according to an exemplary embodiment of the present disclosure will be explained with reference to the accompanying drawings.

If a user detaches the first and second dust receptacles 120 and 130 that are filled with dirt or dust after the user cleans, the user rotates the rotational handle 220 in the direction indicated by arrow A illustrated in FIG. 1 at the first position, and moves the rotational handle 220 to the second position in which the locking device 200 is unlocked from the cleaner body 100. The rotational handle 220 descends in the direction indicated by arrow B, and accordingly the rotational handle 220 causes the dust separating apparatus 110 to be spaced apart from the first and second dust receptacles 120 and 130 at a specific interval and thus the sealing and locking between the dust separating apparatus 110 and the first and second dust receptacles 120 and 130 are released.

That is, if the rotational handle 220 rotates from the first position to the second position, the first and second dust receptacle 120 and 130 descends while being contacted to the dust separating apparatus 110, and the dust separating apparatus 110 fixed to the cleaner body 100 is unlocked and unsealed from the first dust receptacle 120.

Figure 2:
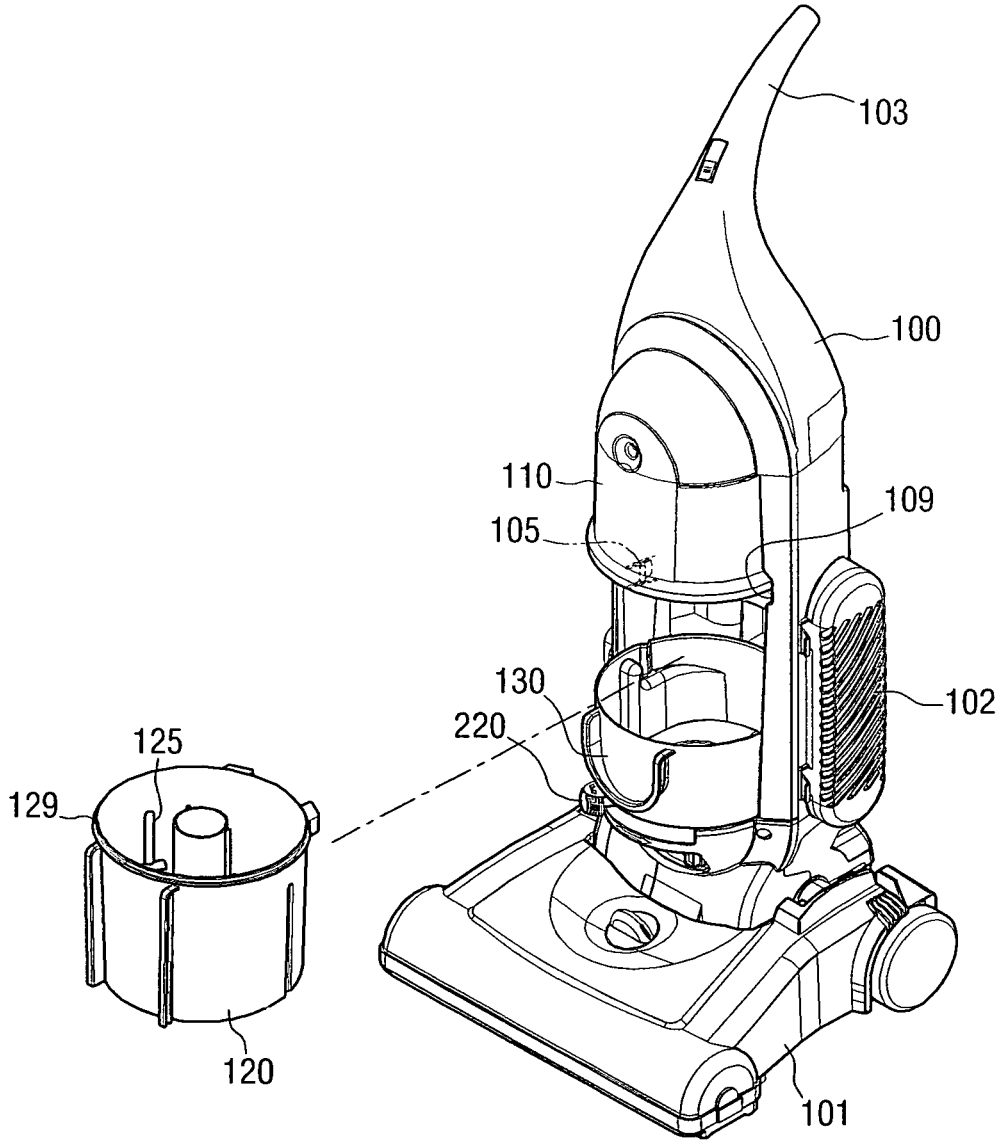
FIGS. 2 to 4 are exploded perspective views illustrating the process of disengaging first and second dust receptacles of a vacuum cleaner according to an exemplary embodiment of the present disclosure.

Referring to FIG. 2, the supporting portion 129 is protrudedly formed around an upper portion of the first dust receptacle 120, and the guide rail 109 that is formed in the cleaner body 100 supports the supporting portion 129. Accordingly, the first dust receptacle 120 descends as much as the first dust receptacle 120 is spaced apart from the dust separating apparatus 110. However, if the guide rail 109 and the supporting portion 129 are contacted and supported with each other, the first dust receptacle 120 does not descend anymore.

The second dust receptacle 130 remains in contact with the rotational handle 220 because the hook 223 is inserted to the hook groove 230. Accordingly, the second dust receptacle 130 continuously descends until the rotational handle 220 reaches to the second position and thus the first dust receptacle 120 is spaced apart from the second dust receptacle at a specific interval.

Thus, the dust separating apparatus 110 is spaced apart from the first and second dust receptacles 120 and 130, and accordingly a user can detach the first dust receptacle 120 in the forward direction of the vacuum cleaner as shown in FIG. 2.

Figure 3:
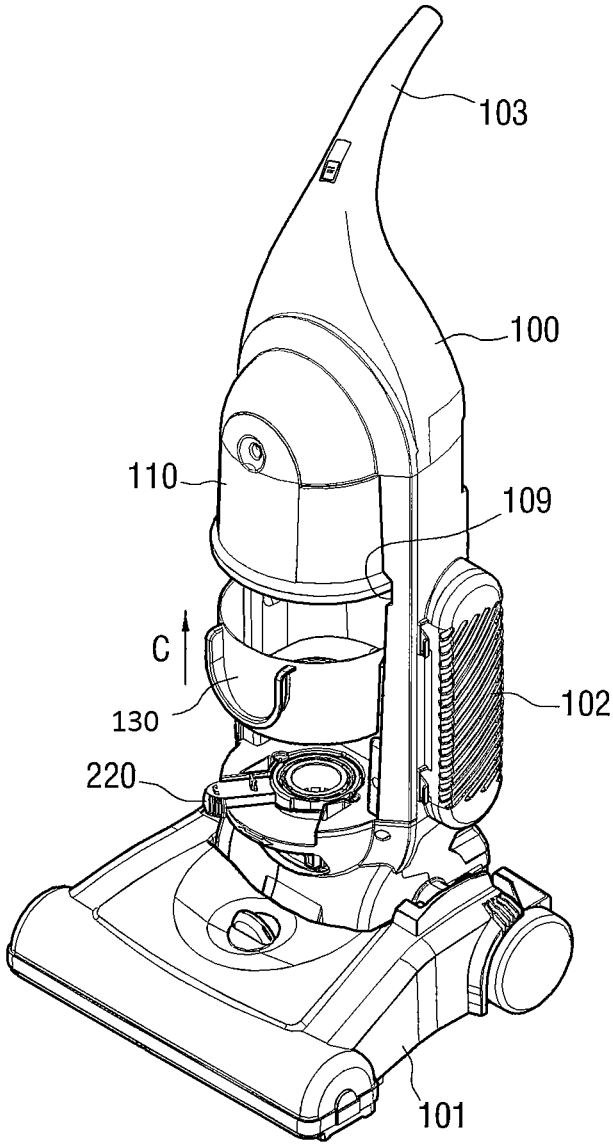

If the first dust receptacle 120 is detached from the cleaner body 100 in the forward direction of the cleaner body 100 as shown in FIG. 2, a user raises the second dust receptacle 130 to the portion where the first dust receptacle 120 is disposed (direction indicated by arrow C) as shown in FIG. 3, and detaches the second dust receptacle 130 from the cleaner body in a forward direction of the cleaner body 100 (direction indicated by arrow D) as shown in FIG. 4.

The guide recess 137 is formed at both sides of the second dust receptacle 130. The guide recess 137 prevents the second dust receptacle 130 from rotating in association with the rotation of the rotational handle 220, and also prevents the second dust receptacle 130 from being detached in the forward direction when the second dust receptacle 130 is placed to be mounted. The reason a user detaches the second dust receptacle 130 forward after raising it upward is to prevent the second dust receptacle 130 from being detached together with the first dust receptacle 120 when the user tries to detach the first dust receptacle 120 while the first dust receptacle 120 is still in contact with the second dust receptacle 130.

The process of engaging the first and second dust receptacles 120 and 130 is performed in reverse order of the above process.

According to the exemplary embodiment of the present disclosure, the process of detaching the first dust receptacle and the second dust receptacle provided for the size of dust particles is performed in association with the operation of detaching the dust separating apparatus and the dust receptacles. Accordingly, a user conveniently detaches the first and second dust receptacles from the cleaner body.

Only the first dust receptacle collecting large particle dust is emptied separately and frequently and thus user's convenience is improved.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner, comprising:

a cleaner body having a guide rail;

a dust separating apparatus fixed to the cleaner body;

a first dust receptacle detachably attached to the cleaner body, the first dust receptacle being disposed on a bottom portion of the dust separating apparatus to collect large particle dust from the dust separating apparatus, the first dust receptacle having a supporting portion for optional engagement with the guide rail;

a second dust receptacle detachably attached to the cleaner body, the second dust receptacle being disposed on a bottom portion of the first dust receptacle to collect fine particle dust from the dust separating apparatus; and a locking device movable between a first position in which the second dust receptacle presses the first dust receptacle toward the dust separating apparatus, disengaging the supporting portion from the guide rail, to provide a seal between the dust separating apparatus and the first and second dust receptacles, and a second position in which the first dust receptacle is spaced apart from the second dust receptacle at a predetermined interval and is suspended from the cleaner body as the guide rail is engaged with the supporting portion.

2. The vacuum cleaner of claim 1, wherein the second dust receptacle can be detached from the first dust receptacle at the second position, and can be detached from the cleaner body after the first dust receptacle is disengaged from the cleaner body.

3. The vacuum cleaner of claim 2, wherein the locking device comprises:

a slope way formed on the cleaner body to face a bottom surface of the second dust receptacle; and a rotational handle that ascends and descends along the slope way to move the second dust receptacle upward or downward.

4. The vacuum cleaner of claim 3, wherein the rotational handle comprises:

a handle body;

a lever that protrudes from the handle body; and a hook that protrudes on an upper portion of the lever.

5. The vacuum cleaner of claim 4, wherein at least one auxiliary slope way is formed inside the slope way to correspond to a portion of the handle body.

6. The vacuum cleaner of claim 5, wherein the handle body comprises:

an auxiliary sliding slope way that is formed to have a shape corresponding to the auxiliary slope way on a portion facing the auxiliary slope way.

7. The vacuum cleaner of claim 6, wherein the hook is disposed on the lever and protrudes towards the second dust receptacle, and the second dust receptacle comprises a hook groove that faces the hook, wherein the hook is hooked with the hook groove at the first position, maintains connection between the second dust receptacle and the handle body while moving to the second position, and lowers the second dust receptacle away from the first dust receptacle.

8. The vacuum cleaner of claim 7, wherein the hook groove comprises:

an opening portion into or from which the hook is inserted or detached at the second position; and a blocking member that prevents the hook from being detached from the opening portion when the hook moves to the first position.

9. The vacuum cleaner of claim 1, wherein the first dust receptacle can be detached in the forward direction of the cleaner body, and the second dust receptacle can be raised to a portion where the first dust receptacle is disposed, and can be detached in the forward direction of the cleaner body.

10. The vacuum cleaner of claim 9, wherein the cleaner body further comprises:

a first protruding unit disposed on an interior surface of the cleaner body and oppositely disposed to an outer surface of the first dust receptacle so that the first protruding unit prevents the first dust receptacle from rotating about the cleaner body; and a second protruding unit disposed on the interior surface of the cleaner body and oppositely disposed to an outer surface of the second dust receptacle so that the second protruding unit prevents the second dust receptacle from rotating about the cleaner body.

11. The vacuum cleaner of claim 10, wherein the first dust receptacle comprises a guide groove for engagement with the first protruding unit, and the second dust receptacle comprises a guide recess for engagement with the second protruding unit.

12. The vacuum cleaner of claim 3, wherein the second dust receptacle comprises an air outlet on a bottom surface thereof.

13. The vacuum cleaner of claim 12, wherein the rotational handle comprises:

an air passage that is formed in communication with the air output.

* * * * *